US007261398B2

(12) United States Patent
Greer

(10) Patent No.: US 7,261,398 B2
(45) Date of Patent: Aug. 28, 2007

(54) INKJET INK TANK WITH INTEGRAL PRIMING PISTON

(75) Inventor: David Emerson Greer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 323 days.

(21) Appl. No.: 11/006,087

(22) Filed: Dec. 7, 2004

(65) Prior Publication Data

US 2006/0119673 A1 Jun. 8, 2006

(51) Int. Cl.
*B41J 2/175* (2006.01)

(52) U.S. Cl. ..... 347/85; 347/87

(58) Field of Classification Search ..... 347/85, 347/87; 600/399; 277/364
See application file for complete search history.

(56) References Cited

U.S. PATENT DOCUMENTS 4,577,203 A 3/1986 Kawamura
5,039,999 A 8/1991 Winslow et al.
5,724,081 A * 3/1998 Maechler et al. ..... 347/87
5,801,737 A 9/1998 Sato et al.
5,889,543 A 3/1999 Miyazawa et al.
6,048,055 A 4/2000 Hakkaku
6,149,267 A * 11/2000 Geissmann ..... 347/87
6,364,448 B2 4/2002 Nishioka et al.
6,378,998 B2 4/2002 Lim et al.
2003/0088168 A1* 5/2003 Luce ..... 600/399

* cited by examiner

*Primary Examiner*—Hai Pham
*Assistant Examiner*—Carlos A. Martinez, Jr.
(74) *Attorney, Agent, or Firm*—Taft, Stettinius & Hollister

(57) ABSTRACT

An ink tank for an ink jet printer having one or more ink reservoir chambers, and a priming piston or pistons incorporated into the tank. The piston can be activated by a linkage in the printer such that when the tank is installed in the printer, the piston is depressed to the end of its travel. This forces a volume of ink out of the ink exit orifice, through the ink channels in the printhead, and into the ink ejector chip, thereby priming the printhead. The priming piston contains a sealing section with annular rings and a venting section with a circuitous venting path such as helical rings. The interaction of these two sections of the piston with orifices on the walls of the priming cylinder allows the ink reservoir chambers to be vented during shipping and storage, pressurized during priming, and vented after priming.

63 Claims, 4 Drawing Sheets

INKJET INK TANK WITH INTEGRAL PRIMING PISTON

BACKGROUND OF THE INVENTION

This invention relates to an ink tank for an ink jet printhead.

Ink jet printheads include an ink tank (reservoir), some form of pressure regulator, an ejector chip (such as a heater chip) with nozzle plate, a filter, and ink passages to carry ink from the ink reservoir to the ejector chip. The ejector chip jets the ink out through the nozzle plate. The ink reservoir can be integral with the printhead or can be a separate, removable tank. A printhead with ink reservoirs contained in separate, removable tanks should be able to continue operating after the tank is removed and replaced. When a tank is removed, air can be drawn into the printhead and can cause some or all of the ink ejection nozzles to be starved of ink, which can cause print defects. Additionally, in a replaceable tank system the ink ejector chip may fill with air if the tank is run too low.

In order for the ink ejector chip to eject ink droplets, ink must be present in or at the chip. If air is present in the ink ejector chip, the chip may not effectively eject droplets and may not effectively draw ink from the tank or reservoir. It is therefore often necessary to purge the air from the printhead after a new tank is installed. This process is referred to as retiring the printhead. The present invention provides an apparatus that reprimes the printhead when a new tank is installed.

SUMMARY

The present invention provides an ink tank with one or more ink reservoir chambers, and a priming piston or pistons incorporated into the tank. The piston can be activated by a linkage in the printer such that when the tank is first installed, the piston will be actuated. This draws a volume of ink out of the ink exit orifice, through the ink channels in the printhead, and into the ink ejector chip, thereby retiring the printhead.

Accordingly, it is a first aspect of the present invention to provide an ink tank for an inkjet printer, including: a tank body having at least one chamber for holding ink, and at least one outlet through which ink may pass to feed ink to a printhead; at least one priming cylinder in fluid communication with the at least one chamber and enclosing a displacement volume; and at least one piston capable of sliding longitudinally within the at least one priming cylinder, whereby at least a portion of the displacement volume is expelled into the at least one chamber upon actuation of the piston. The piston can include a section containing at least one annular ring around its lateral surface, where the annular ring forms a seal with the wall of the priming cylinder. In one more detailed embodiment, the piston can include a section containing helical rings around its lateral surface, where the gap between adjacent helical rings forms a circuitous vent path through which air can travel. In an alternate more detailed embodiment, the piston can include a section containing a serpentine path on its lateral surface, where the serpentine path forms a vent path through which air can travel.

Either of these more detailed embodiments may be practiced with the following variations. The priming cylinder can include a first orifice in fluid communication with atmosphere, and second and third orifices in fluid communication with the chamber. The first orifice of the priming cylinder can be in fluid communication with the second and third orifices of the priming cylinder if the piston is positioned at the beginning point in its stroke. The first orifice of the priming cylinder can be isolated from fluid communication with the second and third orifices of the priming cylinder if the piston is positioned such that its annular rings are located between the first and second orifices of the priming cylinder. At least a portion of the displacement volume can be expelled into the chamber if the piston is positioned such that its annular rings are located between the first and second orifices of the priming cylinder, and if the piston slides longitudinally toward the second and third orifices of the priming cylinder. The second orifice of the priming cylinder can be in fluid communication with atmosphere if the piston is positioned such that the second orifice of the priming cylinder is located between the at least one annular ring and the helical rings.

In an alternative embodiment of the first aspect of the present invention, the tank body has an open top, a separate lid component covering the open top of the tank body, and the priming cylinder is molded integrally with the lid. This alternative embodiment may be practiced with all the variations and detailed embodiments described above.

It is a second aspect of the present invention to provide an ink tank for an inkjet printer, including: a tank body having a plurality of chambers for holding ink, each of the plurality of chambers having an outlet through which ink may pass to feed ink to a printhead; a plurality of priming cylinders, each of which is in fluid communication with one of the plurality of chambers, and each of which encloses a displacement volume; and a plurality of pistons, each of which is capable of sliding longitudinally within one of the plurality of priming cylinders, whereby at least a portion of each of the plurality of displacement volumes is expelled into one of the plurality of chambers upon actuation of the plurality of pistons. The second aspect of the present invention may be practiced in all the variations and embodiments described above for the first aspect.

It is a third aspect of the present invention to provide a method for priming an inkjet printhead comprising the steps of: providing an ink tank having: (a) a tank body having at least one chamber for holding ink, and at least one outlet through which ink may pass to feed ink to a printhead; (b) at least one priming cylinder in fluid communication with the at least one chamber and enclosing a displacement volume; and (c) at least one piston capable of sliding longitudinally within the at least one priming cylinder; and actuating the piston such that least a portion of the displacement volume is expelled into the at least one chamber. In a detailed embodiment, the step of actuating the piston comprises the act of sliding the piston longitudinally within the priming cylinder. In a more detailed embodiment, the act of sliding the piston longitudinally within the priming cylinder is performed by application of a force by a mechanism external to the ink tank. The piston can include a section containing at least one annular ring around its lateral surface, where the annular ring forms a seal with the wall of the priming cylinder. The piston can include a section containing helical rings around its lateral surface, where the gap between adjacent helical rings forms a circuitous vent path through which air can travel. Alternatively, the piston can include a section containing a serpentine path on its lateral surface, where the serpentine path forms a vent path through which air can travel.

DETAILED DESCRIPTION

The present invention provides an ink tank with one or more ink reservoir chambers, and a priming piston or pistons incorporated into the tank. The piston can be activated by a linkage in the printer such that when the tank is first installed, the piston will be actuated. This draws a volume of ink out of the ink exit orifice, through the ink channels in the printhead, and into the ink ejector chip, thereby retiring the printhead. Since the ink ejector chip primarily ingests air when the tank is emptied, a reprime is particularly needed when a new full tank is installed.

Figure 1:
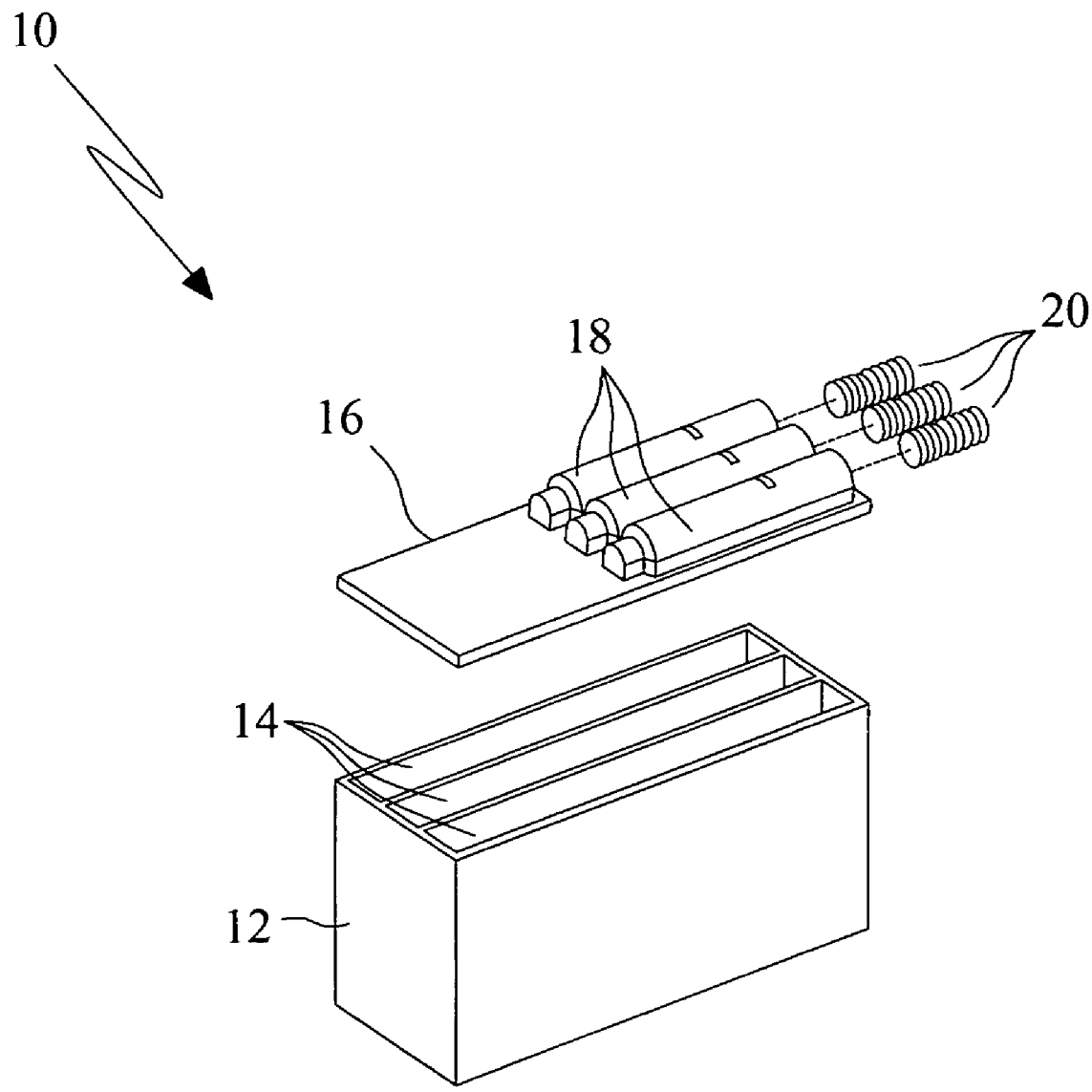
FIG. 1 shows a top isometric view of the ink tank and the tank lid containing the priming mechanism, according to an exemplary embodiment of the present invention.

FIG. 1 shows an exploded view of a multi-chamber ink tank 10 according to an exemplary embodiment of the present invention. The ink tank includes a body component 12 having one or more ink reservoirs or chambers 14, which can be used to hold different colors of ink. A tank lid 16 fits onto the top of the body component 12 and encloses the chambers 14. In the exemplary embodiment shown, the tank lid 16 contains one or more priming cylinders 18, one for each chamber 14; however, it is within the scope of the present invention to form the ink tank with a top surface containing the priming cylinders as one piece, without a separate lid component. Each priming cylinder 18 contains a piston 20 that can slide from one end of the cylinder to the other end of the cylinder.

Figure 2:
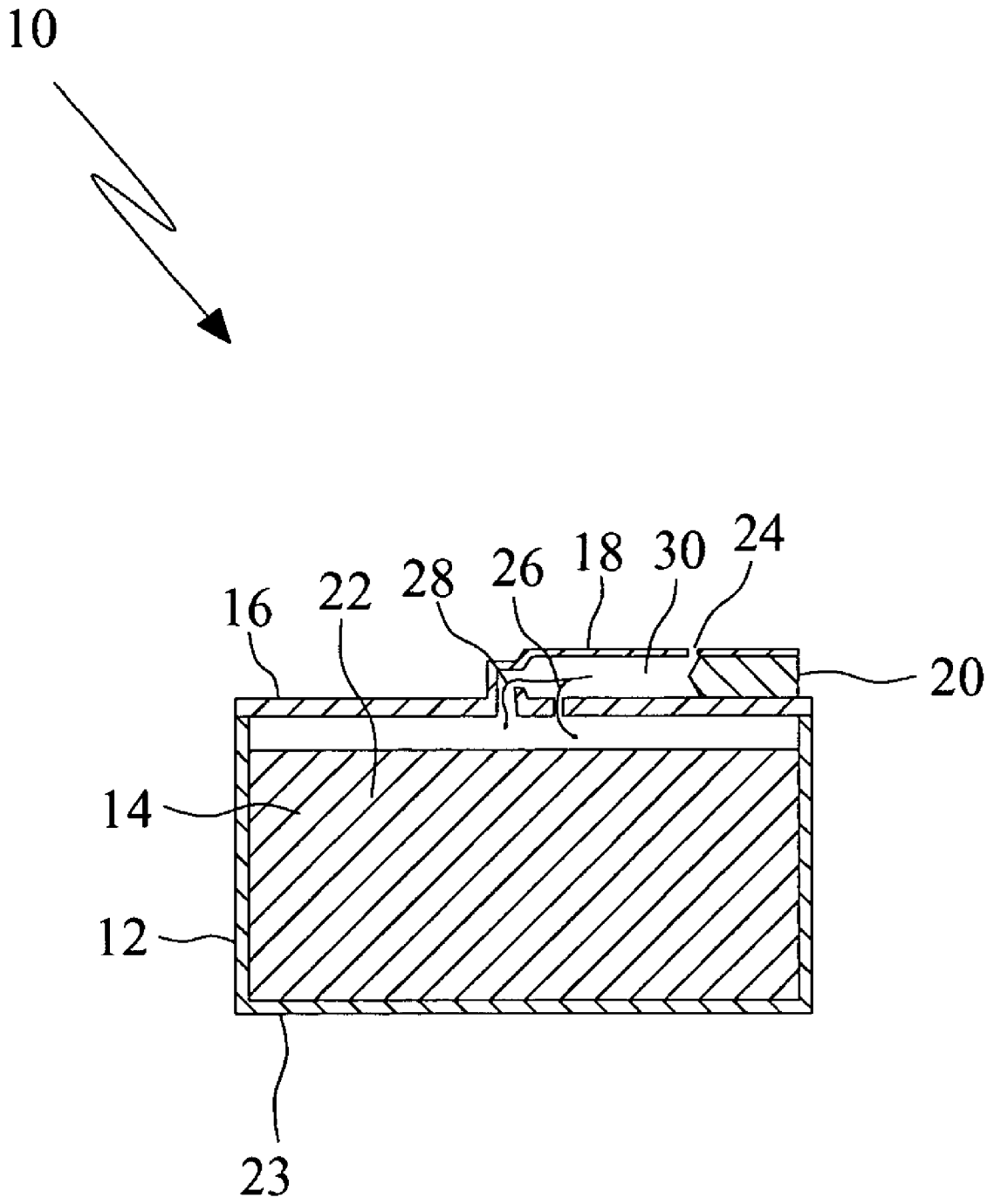
FIG. 2 is a cross section of the ink tank and tank lid showing the priming piston at the starting position, according to an exemplary embodiment of the present invention.

FIG. 2 shows a cross-sectional side view of the ink tank 10. In the view of FIG. 2, the tank lid 16 is affixed to the body component 12, enclosing the chamber 14. Only one chamber is visible in FIG. 2 because this drawing is a two-dimensional view but, as noted above, additional chambers can be included along the axis perpendicular to the plane of FIG. 2. The ink chamber 14 can be filled with foam or other material 22 to hold the ink. The priming cylinder 18 can be seen on the top of the tank lid 16, and the piston 20 is located inside the priming cylinder 18. The ink exit orifice 23 is located on the bottom of the tank body 12 and allows ink to be delivered from the chamber 14 to the ink channels and ejector chip of the printhead.

As seen in FIG. 2, the wall of the priming cylinder 18 has three openings or ports 24, 26, and 28. The first port 24 is located on the top of the priming cylinder 18 and is open to the ambient air outside the ink tank. The second and third ports 26 and 28 are located at the opposite end of the priming cylinder and are open to the inside of the ink chamber 14. In the view of FIG. 2, the piston 20 is in its starting position, at the beginning of its stroke. In this state, air may flow from the inside of the ink chamber 14 through the inside ports 26 and 28, and through the outside port 24 to atmosphere. This configuration allows the inside of the tank to be vented during shipping to prevent any pressure build up within the tank.

FIG. 2 shows that the first port 24 is adjacent to the piston 20 at starting position. As soon as the piston 20 begins its stroke by moving to the left, the first port 24 (which vents to atmosphere) is sealed by the piston. As the piston 20 travels down the cylinder 18 (to the left in FIG. 2), the volume 30 in the cylinder is forced into the ink tank chamber 14 through the second and third ports 26 and 28, which in turn pressurizes the ink within the chamber 14 toward the ink exit orifice 23. In the exemplary embodiment, this cylinder displacement volume 30 is of sufficient size to reprime the ink ejection chip in fluid communication with the ink exit orifice 23.

Figure 3:
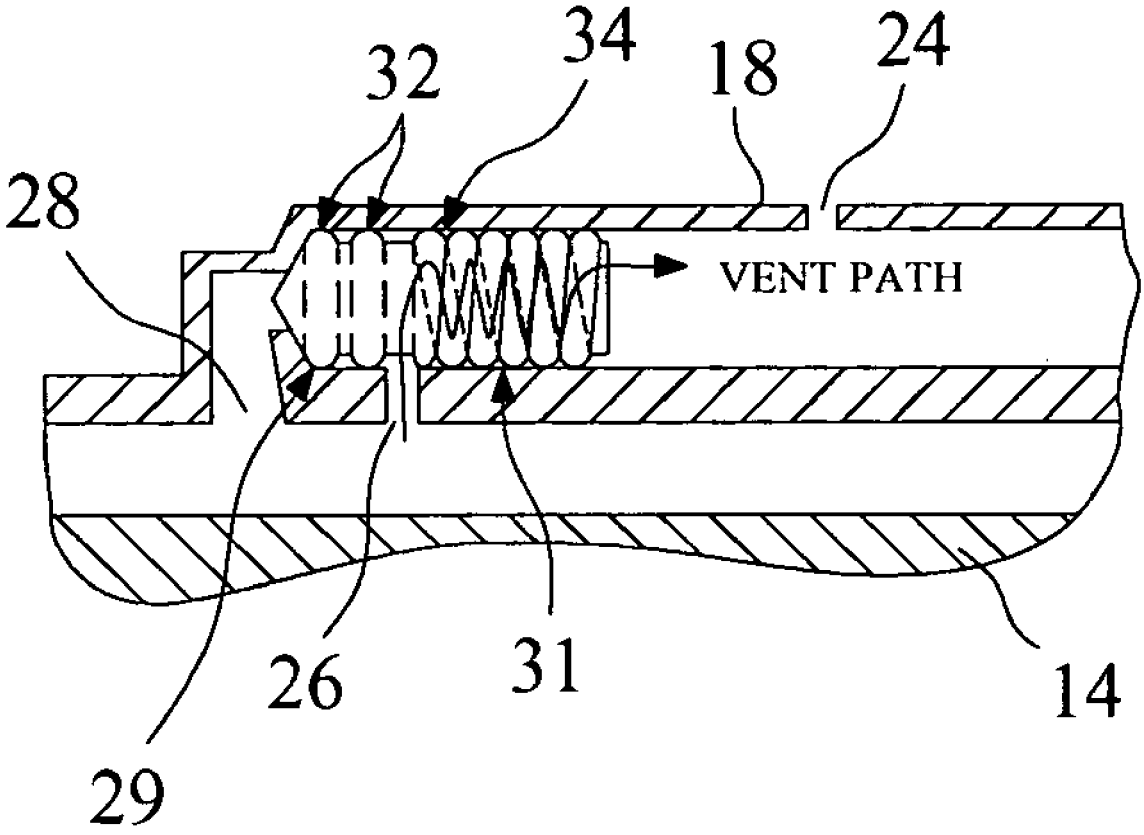
FIG. 3 is a close-up cross section of the area indicated in FIG. 4, showing the priming piston with its annular-ringed sealing section and helical-ringed venting section, according to an exemplary embodiment of the present invention.

FIG. 3 provides a close-up cross-sectional view of showing the piston 20 in the priming cylinder 18 and serves to illustrate the shape of the piston. The first port 24, which vents to atmosphere, and the second and third ports 26 and 28, which vent to the inside of the ink tank chamber 14, are visible. In the exemplary embodiment, the piston 20 has two electrometric sections: a sealing section 29 and a venting section 31. The leading portion (left end in FIG. 3) of the piston, which constitutes the sealing section 29, has two annular rings 32, which form a seal with the cylinder wall. The rear portion (right end in FIG. 3) of the piston 20, which constitutes the venting section 31, has helical rings 34 around its lateral surface that fit snugly against the cylinder wall but form a long circuitous path to atmosphere behind the piston (to the right in FIG. 3). In an alternative embodiment, the lateral surface of the piston's venting section can have a serpentine path to allow venting. As used herein, the "serpentine path" can be a path having any shape that is formed on the lateral surface of the piston's venting section, creating a gap between the piston and the cylinder wall through which air can travel from one end of the venting section to the other end of the venting section.

As discussed above, when the ink tank is shipped to customer, the piston is in the starting position shown in FIG. 2, at the beginning of its stroke. In this configuration, all three ports 24, 26, and 28 in the cylinder wall are open and unobstructed, thus allowing the ink chamber 14 to be vented during shipping to prevent any pressure build up within the tank. During shipping, the tank has a temporary seal over the ink exit orifice 23 and is sealed in an airtight bag to control evaporation.

Upon installation of the ink tank in a printer, the ink exit orifice 23 is unsealed, and the ink tank is ready for priming. Priming is performed by sliding the piston to the left inside the cylinder, which can be accomplished by application of force to the piston by a mechanism in the printer in the exemplary embodiment. With reference to FIGS. 2 and 3, immediately after the piston begins moving to the left, the first (outside) vent port 24 is sealed off by the annular rings 32, which form a seal with the cylinder wall. Once the annular rings 32 move past (i.e. to the left of) the first port 24, the cylinder volume 30 is no longer vented to atmosphere. Thereafter, as the piston continues sliding to the left in the cylinder, the cylinder displacement volume 30 decreases, and the displaced air is forced through the second and third ports 26 and 28 and into the chamber 14. The resulting increase in pressure inside the chamber 14 will force ink out the ink exit orifice 23, from where it will make its way to the printer's ink channels and ink ejector chip. This flow of ink primes the ink channels and ink ejector chip.

Figure 4:
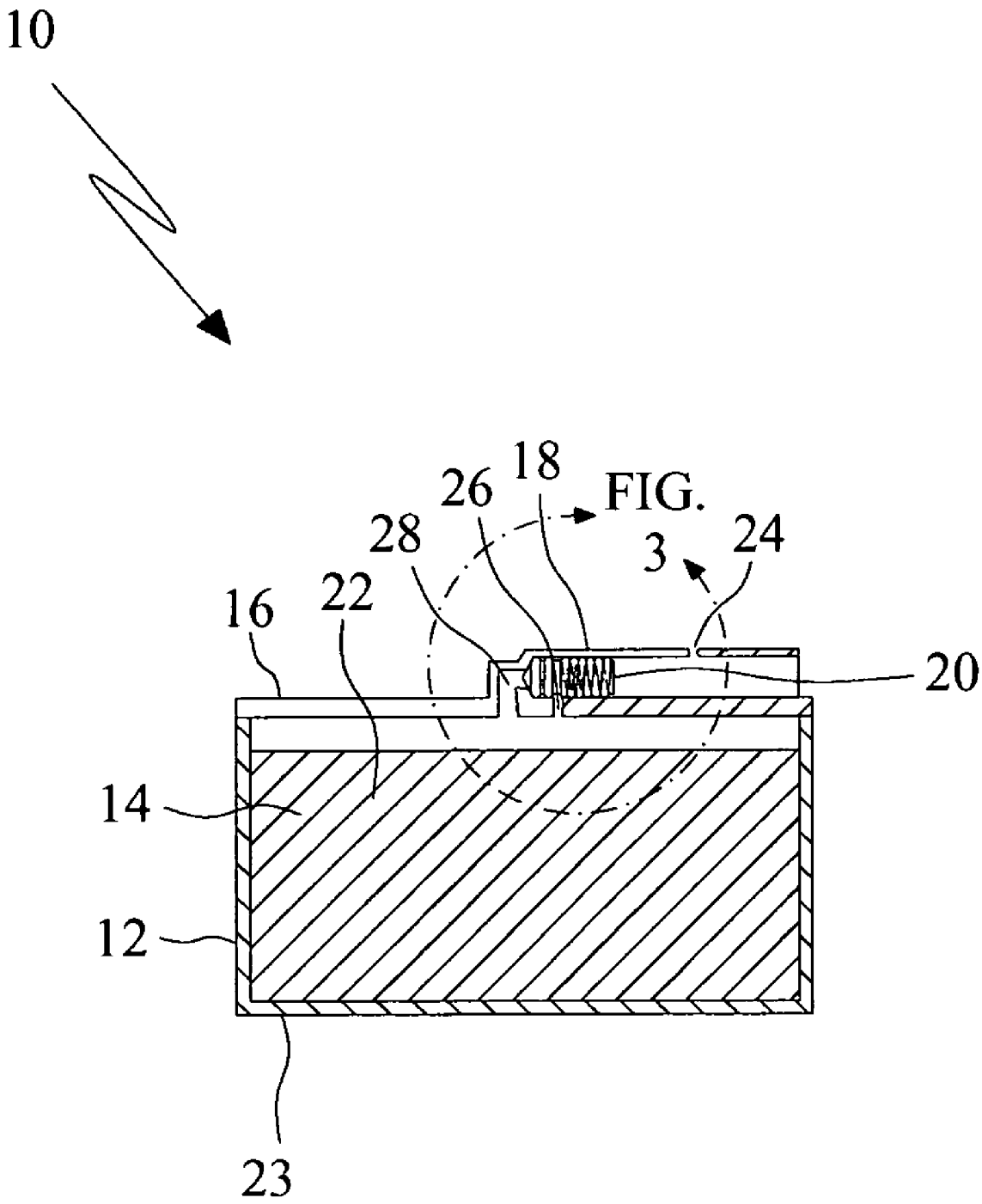
FIG. 4 is a cross section of the ink tank and tank lid showing the priming piston at the ending position, according to an exemplary embodiment of the present invention.

FIGS. 3 and 4 show the piston in its final position at the end of its stroke, after it has finished sliding to the left in the cylinder. In this position, the annular rings 32 on the piston 20 have moved beyond (i.e. to the left of) the second port 26. To the right of the second port 26 are the piston's helical rings 34, which allow air to flow tangentially along the path between adjacent rings. The helical rings 34 thus form a long, circuitous path from the second port 26 to atmosphere behind (to the right of) the piston 20. By means of this path, the ink chamber 14 is vented to atmosphere because air can flow from atmosphere, along the circuitous path formed by the piston's helical rings 34, through the second port 24, and into the chamber 14. This allows the tank to inhale air as the ink is drained while at the same time control evaporation of the ink.

This invention provides a priming piston that allows the tank to be vented during shipping, sealed and pressurized during priming, and control evaporation and venting after prime.

Having described the invention with reference to exemplary embodiments, it is to be understood that the invention is defined by the claims and it not intended that any limitations or elements describing the exemplary embodiment set forth herein are to be incorporated into the meanings of the claims unless such limitations or elements are explicitly listed in the claims. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. An ink tank for an inkjet printer, comprising:

a tank body including a chamber for housing a printer ink, and at least one outlet through which the printer ink may pass to feed the printer ink to a printhead;

a priming passageway at least partially housing a displacement fluid in fluid communication with the chamber, the priming passageway including a first orifice that is in fluid communication with an interior of the chamber; and a ram reciprocally repositionable within the priming passageway, the ram including a pathway for fluid travel that selectively establishes fluid communication between the interior of the chamber and an external fluid environment when a portion of the pathway overlaps the first orifice through the priming passageway, whereby at least a portion of the displacement fluid egresses from the priming passageway and into the chamber upon cycling of the ram within the priming passageway.

2. The ink tank of claim 1, wherein the ram includes an annular ring around its lateral surface; and wherein the annular ring forms a seal between the priming passageway and the ram.

3. The ink tank of claim 2, wherein the ram includes helical rings around its lateral surface; and wherein a gap between at least two of the helical rings at least partially defines the pathway through which fluid can travel.

4. The ink tank of claim 3, wherein the priming passageway includes a second orifice in constant fluid communication with the external fluid environment, and a third orifice in constant fluid communication with the interior of the chamber.

5. The ink tank of claim 2, wherein the pathway of the ram includes a serpentine path on its lateral surface; and wherein the serpentine path forms a vent path with a second orifice through which fluid can travel to or from the external fluid environment.

6. The ink tank of claim 5, wherein the priming passageway includes the second orifice in constant fluid communication with the external fluid environment, and a third orifice in constant fluid communication with the interior of the chamber.

7. The ink tank of claim 1, wherein the tank body has an open top; and further comprising a lid covering the open top of the tank body; wherein the at least one priming passageway is molded integrally with the lid.

8. The ink tank of claim 7, wherein the ram includes an annular ring around its lateral surface; and wherein the annular ring forms a seal between the priming passageway and the ram.

9. The ink tank of claim 8, wherein the ram includes helical rings around its lateral surface; and wherein a gap between at least two of the helical rings at least partially defines the pathway through which fluid can travel.

10. The ink tank of claim 9, wherein the priming passageway includes a second orifice in constant fluid communication with the external fluid environment, and a third orifice in constant fluid communication with the interior of the chamber.

11. The ink tank of claim 8, wherein the pathway of the ram includes a serpentine path on its lateral surface; and wherein the serpentine path forms a vent path with a second orifice trough which fluid can travel to or from the external fluid environment.

12. The ink tank of claim 11, wherein the priming passageway includes the second orifice in constant fluid communication with the external fluid environment, and a third orifice in constant fluid communication with the interior of the chamber.

13. An ink tank for an inkjet printer, comprising:

a tank body having at least one chamber for holding ink, and at least one outlet through which ink may pass to feed ink to a printhead;

at least one priming cylinder in fluid communication with the at least one chamber and enclosing a displacement volume; and at least one piston capable of sliding longitudinally within the at least one priming cylinder, whereby at least a portion of the displacement volume is expelled into the at least one chamber upon actuation of the piston wherein the priming cylinder includes a first orifice in fluid communication with atmosphere, and second and third orifices in fluid communication with the chamber;

wherein a first orifice of the priming cylinder is in fluid communication with the second and third orifices of the priming cylinder if the piston is positioned at the beginning point in its stroke.

14. The ink tank of claim 13, wherein the first orifice of the priming cylinder is isolated from fluid communication with the second and third orifices of the priming cylinder if the piston is positioned such that annular rings of the piston are located between the first end second orifices of the priming cylinder.

15. The ink tank of claim 14, wherein at least a portion of the displacement volume is expelled into the chamber if the piston is positioned such that the annular rings are located between the first and second orifices of the priming cylinder, and if the piston slides longitudinally toward the second and third orifices of the priming cylinder.

16. The ink tank of claim 15, wherein the second orifice of the priming cylinder is in fluid communication with atmosphere if the piston is positioned such that the second orifice of the priming cylinder is located between at least one annular ring and helical rings of the piston.

17. An ink tank for an inkjet printer, comprising:

a tank body having at least one chamber for holding ink, and at least one outlet through which ink may pass to feed ink to a printhead;

at least one priming cylinder in fluid communication with the at least one chamber and enclosing a displacement volume; and at least one piston capable of sliding longitudinally within the at least one priming cylinder, whereby at least a portion of the displacement volume is expelled into the at least one chamber upon actuation of the piston;

wherein the piston includes a section containing at least one an annular ring around its lateral surface; and wherein the at least one annular ring forms a seal with the wall of the priming cylinder wherein the piston includes a section containing a serpentine path on its lateral surface; and wherein the serpentine path forms a vent path through which air can travel;

wherein the priming cylinder includes a first orifice in fluid communication with atmosphere, and second and third orifices in fluid communication with the chamber;

wherein the first orifice of the priming cylinder is in fluid communication with the second and third orifices of the priming cylinder if the piston is positioned at the beginning point in its stroke.

18. The ink tank of claim 17, wherein the first orifice of the priming cylinder is isolated from fluid communication with the second and third orifices of the priming cylinder if the piston is positioned such that its annular rings are located between the first and second orifices of the priming cylinder.

19. The ink tank of claim 18, wherein the displacement volume is expelled into the chamber if the piston is positioned such that its annular rings are located between the first and second orifices of the priming cylinder, and if the piston slides longitudinally toward the second and third orifices of the priming cylinder.

20. The ink tank of claim 19, wherein the second orifice of the priming cylinder is in fluid communication with atmosphere if the piston is positioned such that the second orifice of the priming cylinder is located between the at least one annular ring and the serpentine path.

21. An ink tank for an inkjet printer, comprising:

a tank body having at least one chamber for holding ink, and at least one outlet through which ink may pass to feed ink to a printhead;

at least one priming cylinder in fluid communication with the at least one chamber and enclosing a displacement volume; and at least one piston capable of sliding longitudinally within the at least one priming cylinder, whereby at least a portion of the displacement volume is expelled into the at least one chamber upon actuation of the piston;

wherein the tank body has an open top; and further comprising a lid covering the open top of the tank body; wherein the at least one priming cylinder is molded integrally with the lid;

wherein the piston includes a section containing at least one annular ring around its lateral surface;

wherein the at least one annular ring forms a seal with the wall of the priming cylinder;

wherein the piston includes a section containing helical rings around its lateral surface;

wherein the gap between adjacent helical rings forms a circuitous vent path through which air can travel;

wherein the priming cylinder includes a first orifice in fluid communication with atmosphere, and second and third orifices in fluid communication with the chamber; and wherein the first orifice of the priming cylinder is in fluid communication with the second and third orifices of the priming cylinder if the piston is positioned at the beginning point in its stroke.

22. The ink tank of claim 21, wherein the first orifice of the priming cylinder is isolated from fluid communication with the second and third orifices of the priming cylinder if the piston is positioned such that its annular rings are located between the first and second orifices of the priming cylinder.

23. The ink tank of claim 22, wherein at least a portion of the displacement volume is expelled into the chamber if the piston is positioned such that its annular rings are located between the first and second orifices of the priming cylinder, and if the piston slides longitudinally toward the second and third orifices of the priming cylinder.

24. The ink tank of claim 23, wherein the second orifice of the priming cylinder is in fluid communication with atmosphere if the piston is positioned such that the second orifice of the priming cylinder is located between the at least one annular ring and the helical rings.

25. An ink tank for an inkjet printer, comprising:

a tank body having at least one chamber for holding ink, and at least one outlet through which ink may pass to feed ink to a printhead;

at least one priming cylinder in fluid communication with the at least one chamber and enclosing a displacement volume; and at least one piston capable of sliding longitudinally within the at least one priming cylinder, whereby at least a portion of the displacement volume is expelled into the at least one chamber upon actuation of the piston;

wherein the tank body has an open top; and further comprising a lid covering the open top of the tank body; wherein the at least one priming cylinder is molded integrally with the lid;

wherein the piston includes a section containing at least one annular ring around its lateral surface;

wherein the at least one annular ring forms a seal with the wall of the priming cylinder;

wherein the piston includes a section containing a serpentine path on its lateral surface;

wherein the serpentine path forms a vent pat through which air can travel;

wherein the priming cylinder includes a first orifice in fluid communication with atmosphere, and second and third orifices in fluid communication with the chamber;

wherein the first orifice of the priming cylinder is in fluid communication with the second and third orifices of the priming cylinder if the piston is positioned at the beginning point in its stroke.

26. The ink tank of claim 25, wherein the first orifice of the priming cylinder is isolated from fluid communication with the second and third orifices of the priming cylinder if the piston is positioned such that its annular rings are located between the first and second orifices of the priming cylinder.

27. The ink tank of claim 26, wherein the displacement volume is expelled into the chamber if the piston is positioned such that its annular rings are located between the first and second orifices of the priming cylinder, and if the piston slides longitudinally toward the second and third orifices of the priming cylinder.

28. The ink tank of claim 27, wherein the second orifice of the priming cylinder is in fluid communication with atmosphere if the piston is positioned such that the second orifice of the priming cylinder is located between the at least one annular ring and the serpentine path.

29. An ink tank for an inkjet printer, comprising:

a tank body having a plurality of chambers for holding ink, each of the plurality of chambers having an outlet through which ink may pass to feed ink to a printhead;

a plurality of priming cylinders, each of which is in fluid communication with one of the plurality of chambers, and each of which encloses a displacement volume; and a plurality of pistons, each of which is capable of sliding longitudinally within one of the plurality of priming cylinders, whereby at least a portion of each of the plurality of displacement volumes is expelled into one of the plurality of chambers upon actuation of the plurality of pistons.

30. The ink tank of claim 29, wherein each of the plurality of pistons includes a section containing at least one annular ring around its lateral surface; and wherein the at least one annular ring forms a seal with the wall of one of the plurality of priming cylinders.

31. The ink tank of claim 30, wherein each of the plurality of pistons includes a section containing helical rings around its lateral surface; and wherein the gap between adjacent helical rings forms a circuitous vent path through which air can travel.

32. The ink tank of claim 31, wherein each of the plurality of priming cylinders includes a first orifice in fluid communication with atmosphere, and second and third orifices in fluid communication with one of the plurality of chambers.

33. The ink tank of claim 32, wherein the first orifice of each one of the plurality of priming cylinders is in fluid communication with the second and third orifices of said one of the plurality of priming cylinders if the piston is positioned at the beginning a point in its stroke.

34. The ink tank of claim 33, wherein the first orifice of each one of the plurality of priming cylinders is isolated from fluid communication with the second and third orifices of said one of the plurality of priming cylinders if the piston is positioned such that its annular rings are located between the first and second orifices of said one of the plurality of priming bylinders.

35. The ink tank of claim 34, wherein the displacement volume of each one of the plurality of priming cylinders is expelled into one of the plurality of chambers if the piston is positioned such that its annular rings are located between the first and second orifices of said one of the plurality of priming cylinders, and if the piston slides longitudinally toward the second and third orifices of said one of the plurality of priming cylinders.

36. The ink tank of claim 35, wherein the second orifice of each one of the plurality of priming cylinders is in fluid communication with atmosphere if the piston is positioned such that the second orifice of said one of the plurality of priming cylinders is located between the at least one annular ring and the helical rings.

37. The ink tank of claim 30, wherein each of the plurality of pistons includes a section containing a serpentine path on its lateral surface; and wherein the serpentine path forms a vent path through which air can travel.

38. The ink tank of claim 37, wherein each of the plurality of priming cylinders includes a first orifice in fluid communication with atmosphere, and second and third orifices in fluid communication with one of the plurality of chambers.

39. The ink tank of claim 38, wherein the first orifice of each one of the plurality of priming chambers is in fluid communication with the second and third orifices of said one of the plurality of priming cylinders if the piston is positioned at the beginning a point in its stroke.

40. The ink tank of claim 39, wherein the first orifice of each one of the plurality of priming cylinders is isolated from fluid communication with the second and third orifices of said one of the plurality of priming cylinders if the piston is positioned such that its annular rings are located between the first and second orifices of said one of the plurality of priming cylinders.

41. The ink tank of claim 40, wherein the displacement volume of each one of the plurality of priming cylinders is expelled into one of the plurality of chamber if the piston is positioned such that its annular rings are located between the first and second orifices of said one of the plurality of priming cylinders, and if the piston slides longitudinally toward the second and third orifices of said one of the plurality of priming cylinders.

42. The ink tank of claim 41, wherein the second orifice of each one of the plurality of priming cylinders cylinder is in fluid communication with atmosphere if the piston is positioned such that the second orifice of said one of the plurality of priming cylinders is located between the at least one annular ring and the serpentine path.

43. The ink tank of claim 29, wherein the tank body has an open top; and further comprising a lid covering the open top of the tank body; wherein the plurality of priming cylinders are molded integrally with the lid.

44. The ink tank of claim 43, wherein each of the plurality of pistons includes a section containing at least one annular ring around its lateral surface; and wherein the at least one annular ring forms a seal with the wall of one of the plurality of priming cylinders.

45. The ink tank of claim 44, wherein each of the plurality of pistons includes a section containing helical rings around its lateral surface; and wherein the gap between adjacent helical rings forms a circuitous vent path through which air can travel.

46. The ink tank of claim 45, wherein each of the plurality of priming cylinders includes a first orifice in fluid communication with atmosphere, and second and third orifices in fluid communication with one of the plurality of chambers.

47. The ink tank of claim 46, wherein the first orifice of each one of the plurality of priming cylinders is in fluid communication with the second and third orifices of said one of the plurality of priming cylinders if the piston is positioned at the beginning a point in its stroke.

48. The ink tank of claim 47, wherein the first orifice of each one of the plurality of priming cylinders is isolated from fluid communication with the second and third orifices of said one of the plurality of priming cylinders if the piston is positioned such that its annular rings are located between the first and second orifices of said one of the plurality of priming cylinders.

49. The ink tank of claim 48, wherein the displacement volume of each one of the plurality of priming cylinders is expelled into one of the plurality of chambers if the piston is positioned such that its annular rings are located between the first and second orifices of said one of the plurality of priming cylinders, and if the piston slides longitudinally toward the second and third orifices of said one of the plurality of priming cylinders.

50. The ink tank of claim 49, wherein the second orifice of each one of the plurality of priming cylinders is in fluid communication with atmosphere if the piston is positioned such that the second orifice of said one of the plurality of priming cylinders is located between the at least one annular ring and the helical rings.

51. The ink tank of claim 44, wherein each of the plurality of pistons includes a section containing a serpentine path on its lateral surface; and wherein the serpentine path forms a vent path through which air can travel.

52. The ink tank of claim 51, wherein each of the plurality of priming cylinders includes a first orifice in fluid communication with atmosphere, and second and third orifices in fluid communication with one of the plurality of chambers.

53. The ink tank of claim 52, wherein the first orifice of each one of the plurality of priming chambers is in fluid communication with the second and third orifices of said one of the plurality of priming cylinders if the piston is positioned at the beginning a point in its stroke.

54. The ink tank of claim 53, wherein the first orifice of each one of the plurality of priming cylinders is isolated from fluid communication with the second and third orifices of said one of the plurality of priming cylinders if the piston is positioned such that its annular rings are located between the first and second orifices of said one of the plurality of priming cylinders.

55. The ink tank of claim 54, wherein the displacement volume of each one of the plurality of priming cylinders is expelled into one of the plurality of chamber if the piston is positioned such that its annular rings are located between the first and second orifices of said one of the plurality of priming cylinders, and if the piston slides longitudinally toward the second and third orifices of said one of the plurality of priming cylinders.

56. The ink tank of claim 55, wherein the second orifice of each one of the plurality of priming cylinders cylinder is in fluid communication with atmosphere if the piston is positioned such that the second orifice of said one of the plurality of priming cylinders is located between the at least one annular ring and the serpentine path.

57. A method for priming an inkjet printhead comprising the steps of:

providing an ink tank that includes: (a) a tank body including a chamber for holding a printing ink, and an outlet through which the printing ink may pass to feed the printing ink to a printhead; (b) a priming duct in fluid communication with an interior of the chamber, the priming duct being occupied at least in part by a fluid; and (c) a plunger housed within the priming duct;

actuating the plunger with respect to the priming duct so that at least a portion of the fluid within the priming duct is expelled into the chamber; and establishing an unobstructed vent path through the priming duct to provide fluid communication between an external fluid environment and the interior of the chamber.

58. The method of claim 57, wherein the step of actuating the plunger comprises the act of sliding the plunger longitudinally within the priming duct.

59. The method of claim 58, wherein the act of sliding the plunger longitudinally within the priming duct is performed by application of a force by a mechanism external to the ink tank.

60. The method of claim 59, wherein the plunger includes an annular ring around its lateral surface; and wherein the annular ring forms a seal between the plunger and the priming duct.

61. The method of claim 60, wherein the plunger includes circumscribing helical rings; and wherein a spacing between adjacent helical rings forms a circuitous vent path that comprises the unobstructed vent path.

62. The method of claim 60, wherein the plunger includes an external surface having a serpentine trench; end wherein the serpentine trench comprises the unobstructed vent path.

63. An ink tank for en inkjet printer, comprising:

a tank body having a plurality of chambers for holding ink, each of the plurality of chambers having an outlet through which ink may pass to feed ink to a printhead;

a plurality of priming conduits, each of which is in fluid communication with at least one of the plurality of chambers, and each of which houses a displacement fluid; and a plurality of pistons, each of which is capable of sliding longitudinally within at least one of the plurality of priming conduits, whereby at least a portion of one of the plurality of displacement fluids is expelled into at least one of the plurality of chambers upon actuation of at least one of the plurality of pistons.

* * * * *